United States Patent [19]

Müschenborn et al.

[11] Patent Number: 4,522,342

[45] Date of Patent: Jun. 11, 1985

[54] IMPACT MILL

[75] Inventors: Dieter Müschenborn, Schwerte; Robert Rautenbach, Aachen, both of Fed. Rep. of Germany

[73] Assignees: Heinrich Nickel, Dortmund-Mengede; Ernst Eggeling, Dortmund-Lucklemberg, both of Fed. Rep. of Germany

[21] Appl. No.: 552,497

[22] Filed: Nov. 17, 1983

[30] Foreign Application Priority Data

Nov. 20, 1982 [DE] Fed. Rep. of Germany ..... 3242950
Nov. 20, 1982 [DE] Fed. Rep. of Germany ..... 3242951

[51] Int. Cl.[3] ..... B02C 13/22

[52] U.S. Cl. ..... 241/57; 241/188 A; 241/DIG. 30

[58] Field of Search ..... 241/DIG. 30, 57, 188 A, 241/188 R, 292.1, 296, 297, 298

[56] References Cited

U.S. PATENT DOCUMENTS

| | | | |
|---|---|---|---|
| 250,125 | 11/1881 | Bennett | 241/188 A X |
| 2,338,373 | 1/1944 | Aurig | 241/188 A X |

FOREIGN PATENT DOCUMENTS

| | | | |
|---|---|---|---|
| 42255 | 4/1887 | Fed. Rep. of Germany | 241/188 A |
| 1607582 | 9/1969 | Fed. Rep. of Germany . | |
| 2926042 | 1/1981 | Fed. Rep. of Germany . | |
| 2933592 | 2/1981 | Fed. Rep. of Germany . | |

*Primary Examiner*—Mark Rosenbaum
*Attorney, Agent, or Firm*—Karl F. Ross; Herbert Dubno

[57] ABSTRACT

An impact mill in which the pins of the milling tools are provided with pocket-forming vanes which are oriented substantially radially or tangentially with respect to the rotation circle of the respective tool and, downstream of the pin forming the tool, a streamlined profile is provided to reduce vortex formation and turbulence and thereby improve the energetic efficiency of the mill.

12 Claims, 7 Drawing Figures

IMPACT MILL

FIELD OF THE INVENTION

Our present invention relates to an impact mill and, more particularly, to a mill for the comminution of mineral matter utilizing a pair of discs carrying the milling elements which interdigitate with one another.

BACKGROUND OF THE INVENTION

Among the impact mills which have been developed for the comminution of mineral matter, there are those which have been referred to as "pin mills", e.g. of the type described on pages 8–37 and 8–38 of *Chemical Engineers' Handbook,* McGraw-Hill Book Company, 5th edition, 1973, New York. These mills, as a class, may be described as having a mill housing and two counterrotating rotor discs which are formed with the milling tools generally in an angularly equispaced relationship and in concentric circles so that the tools, generally pins, of the two discs interdigitate. Within each circle of tools the pins are equispaced and the number of pins per circle can vary from an inner part of the disc to an outer part thereof.

The material to be milled can be fed to the milling space within the circles of pins and the milled material is progressively cast outwardly and is discharged at the periphery of the space.

As the milled material is progressively cast outwardly it has increasing fineness and thus the inner pins bring about a coarse milling while the intermediate pins effect an intermediate fineness of milling and the peripheral pins give rise to the ultimate fineness of the product.

The mineral material which can be comminuted by such impact mills includes coal, oil shale, metallurgical ores and the like and, for stablization, the pins of a given circular array can have their ends remote from the respective disc bridged by respective stabilizing rings.

It has been found to be advantageous to provide the milling members or pins with partitions which extend radially with respect to the pins and define compartments associated with the pins.

Such mills are described in, for example, German patent document—open application DE-OS 16 07 582, in which the structure is similar to that of a conventional pin mill and in German patent documents—open applications DE-OS 29 26 042 and DE-OS 29 33 592 which describe systems for reducing the wear by the use of such radial partitions to define compartments.

Because of the formation of these compartments, it appears that the particles of the milled product as they are encountered by each milling tool do not abrasively impact upon the metal of the tool itself, but rather impact upon other particles, generally previously comminuted, in a cushion of the milled product entrained with each milling tool.

Consequently, the impact mill operates primarily by entrainment of a mass of the particles and the impact of this mass on other particles rather than primarily via inpact of the metal pins against the particles so as to minimize wear of the pins or more generally the milling tools. The impact milling operation is an entropy generating process with only part of the energy input resulting in the mechanical size reduction of the product. The balance of the energy is transformed into heat and it is always desirable in such system to maximize the fraction of the energy which is utilized in comminution as opposed to unproductive displacement, turbulence or the like.

Generally, the partitions are oriented at an angle of 45° to the direction of rotation of the discs, an angle which presumably has been found to be advantageous for the impact comminution effect. In practice, results obtained with such systems are poor and we have discovered that these results are, in large measure, a result of the poor aerodynamics of the system which causes this system to be high in energy loss and hence are energy inefficient.

OBJECTS OF THE INVENTION

It is the principal object of the present invention to provide an improved impact mill whereby the disadvantages of earlier impact mills of the type described are avoided.

Another object of this invention is to provide an impact mill which is aerodynamically and energetically more efficient than the earlier mills.

A more specific object of this invention is to provide an impact machine is which, as a result of modification of the aerodynamic effect, energy losses can be minimized.

SUMMARY OF THE INVENTION

We have found that a significant improvement in the energy efficiancy of a mill of the type described can be obtained, while retaining all of the advantages of the earlier systems with respect to reduced wear and operation of the pin, when the individual partitions of the tools, sometimes referred to hereinafter as vanes, are oriented to be substantially radial and tangential with respect to the rotation circle of the tools. The term "substantially radial" and term "substantially tangential" are intended to refer to orientations of the vanes and partitions whereby these are precisely radial or tangential, respectively, as well as to orientations in which these members may include angles of up to 20° with a radial pin or with a tangential pin respectively.

The present invention, therefore, provides, in addition to the housing, a central material feeder and peripheral material recovery means, a pair of counterrotating discs having interdigitating milling tools spaced apart along respective circle and bridged for each circle by a respective stabilizing ring so that between the stablizing rings a milling chamber is flanked, each tool or pin being provided with at least one and preferably a plurality of the aforementioned vanes or partitions which are substantially radial or substantially tangential with respect to the rotation circle.

It has been found to be advantageous, when each pin has a plurality of such vanes or partitions, to provide the vane of each pin most distal from the axis of rotation of the disc so that it is inclined to the radial in a leading direction with respect to the direction of rotation. Correspondingly the vane or partition of each pin more proximal to the axis of rotation of the disc is inclined to the radial in a trailing or lagging orientation with respect to the direction of rotation. In each case, the angle included with the radial can range between 0° and 20, preferably between 10° and 15°, inclusive and most advantageously is about 15° when such inclination is desired.

The invention, surprisingly, obtains an improvement in the operating efficiency by reducing the amount of energy required for a given milling result. While the reasons are not completely clear as to why such a significant improvement can be obtained over systems in which, for example, the vanes and partitions are oriented at an angle of 45° to the radial, it appears that the improvement is a result of the change in the way the material is transferred in steps as it moves from the inlet to the outlet and is a consequence of the significantly reduced turbulence and the limitation of the vortexes in many cases without interfering with the impact action.

With the inclined orientation of the vanes or partitions within the ranges set forth, a still more uniform transfer of material is obtained and indeed for any specific apparatus, material, fine particle source, etc., the angle may be adjusted within the aforementioned range as a function of the position of the tool in the mill, the number of milling circles, the size of the mill, the speed of the discs.

It has been found to be advantageous, moreover, to provide each tool with a trailing profile, i.e. a body having a streamlined shape corresponding to the configuration of the slip stream behind each tool. In cross section, therefore, this body will have an aerodynamic shape, i.e. a shape of a wing or air foil or the shape of a droplet.

In practice, the presence of this body eliminates cavitation phenomena and hence further reduces vortex formation and turbulences.

The tools of the present invention can comprise steel pins which carry the vanes and the trailing profile, the latter being formed preferably from rubber or synthetic resin material.

According to a feature of the invention the vanes or partitions can be provided in a cruciform array on each pin, the compartments downstream of the vanes being filled with the trailing profile which can reach to the substantially radial vanes. The pins, in turn, may be rotatable about the respective axis to set the angular positions of the vanes to suit special milling requirements. When the stabilizing rings lie in the flow path of the milled material so that a furace of a ring is impinged upon by the milling material, this surface and the side of the ring exposed at the mild material can be made convex so that in the concavity thus provided, a cushion of the milling material is provided to intercept the impinging stream and reduce erosion of the ring surface.

The mill operating efficiancy can be improved by a combination of the aforedescribed techniques and especially a system in which the stabilizing rings of one disc interfit with support rings projecting from the other disc and defining labyrinth seals between them so that the milling chamber is defined between substantially planar or flat walls and the rings and the projections lie substantially flush with one another. In an advantageous configuration the discs are frustoconical and hence the milling chamber widens outwardly. The rings can define with the annular projections flanking them on the disc side at which the projections are supported, annular compartments which can be pressurized, e.g. axially through the disc shafts.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
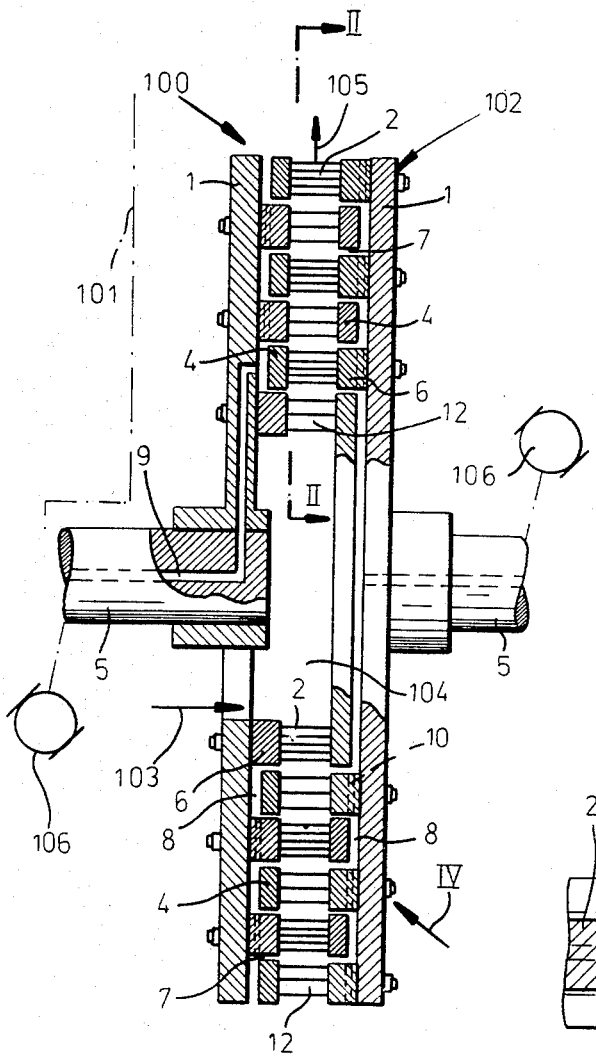
FIG. 1 is an axial section through a portion of the milling members of an impact mill according to the invention.

In FIG. 1 we have shown the essential elements of an impact mill 100 in largely diagrammatic form. These elements include a housing which has been represented only diagrammatically at 101, a milling unit 102 which will be described in greater detail hereinafter, means represented by the arrow 103 for feeding a material to be comminuted into a milling compartment 104 and a means represented by the arrow 105 for discharging the finely milled material.

The apparatus shown can be utilized effectively for the impact milling of mineral materials, especially coal, oil shale and the like.

Figure 2:
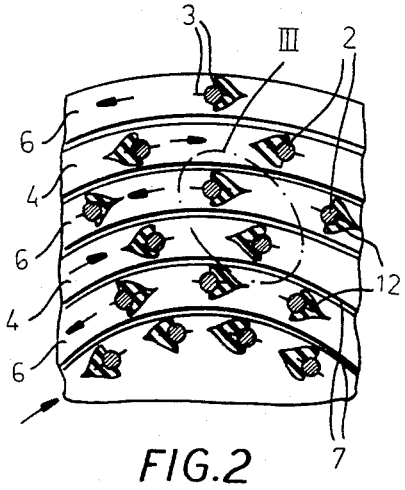
FIG. 2 is a section along the line II—II of FIG. 1.

The milling unit 102 comprises a pair of rotor discs having interdigitating milling tools 2,3, with the tools being spaced apart as shown in FIG. 2 in angularly equispaced relationship along respective concentric circles. In this embodiment, moreover, the spacing between the tools is less inwardly and greater outwardly although all the tools of a particular circle are angularly equispaced with the other tools of the same rotor disc.

Each tool comprises a support pin 2 and vanes or partitions 3 which are mounted thereon. The ends of the pins 2 which are distal from the discs 1 carrying them, are for each circle bridged by a respective stabilizing ring 4.

Each disc is carried by a respective shaft 5 journaled in the housing 101 and the two shafts are driven in opposite senses, e.g. by respective motors 106.

Each disc 1 is also provided with a support ring 6 forming a pedestal and substantially coplanar with the adjustment stabilizing rings of the other disc (see FIG. 4) so that the annular projections 6 and the rings 4 on the same side define one wall of the milling chamber 104 while the other wall is defined by the opposite set of stabilizing rings and projections.

Figure 4:
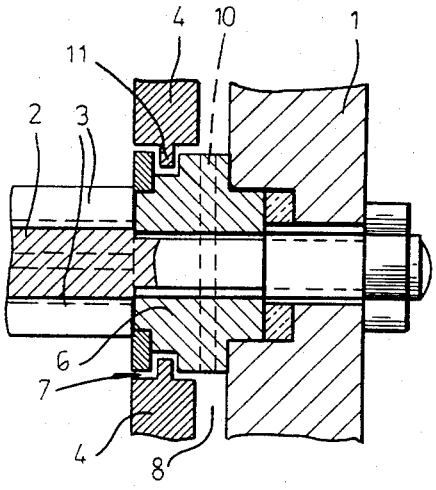
FIG. 4 is a detail view drawn to an enlarged scale of the region IV of FIG. 1.

As can be seen from FIG. 4, the gaps 7 between the rings 4 and the projections 6 are narrow hence these members are flush with one another so that the walls are flat and preferably smooth, i.e. of a minimum roughness. This allows the tolerances to be minimal and especially high speeds to be achieved.

Figure 5:
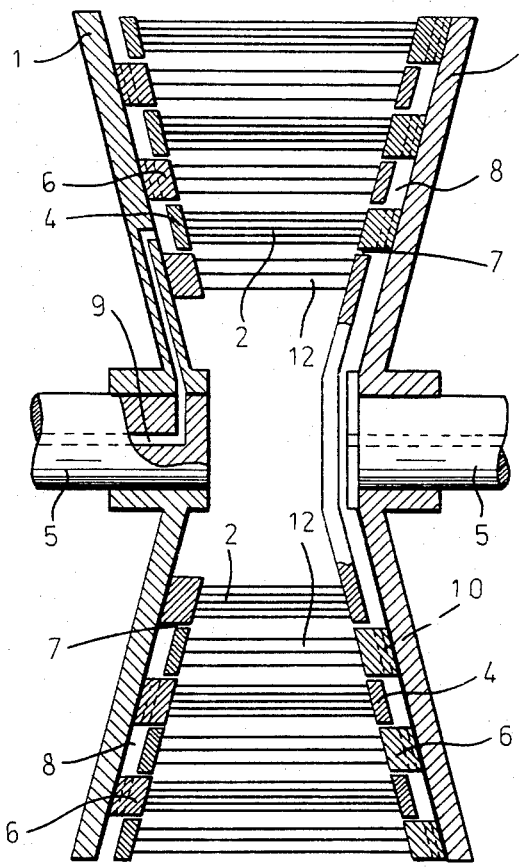
FIG. 5 is a view similar to FIG. 1 illustrating another embodiment.

The walls of the milling chamber 104 are parallel in the embodiment of FIGS. 1 through 4 but can, as seen in FIG. 5, diverge outwardly in the radial direction. Naturally, the reverse is also possible, i.e. these walls can converge radially outwardly.

Figure 3:
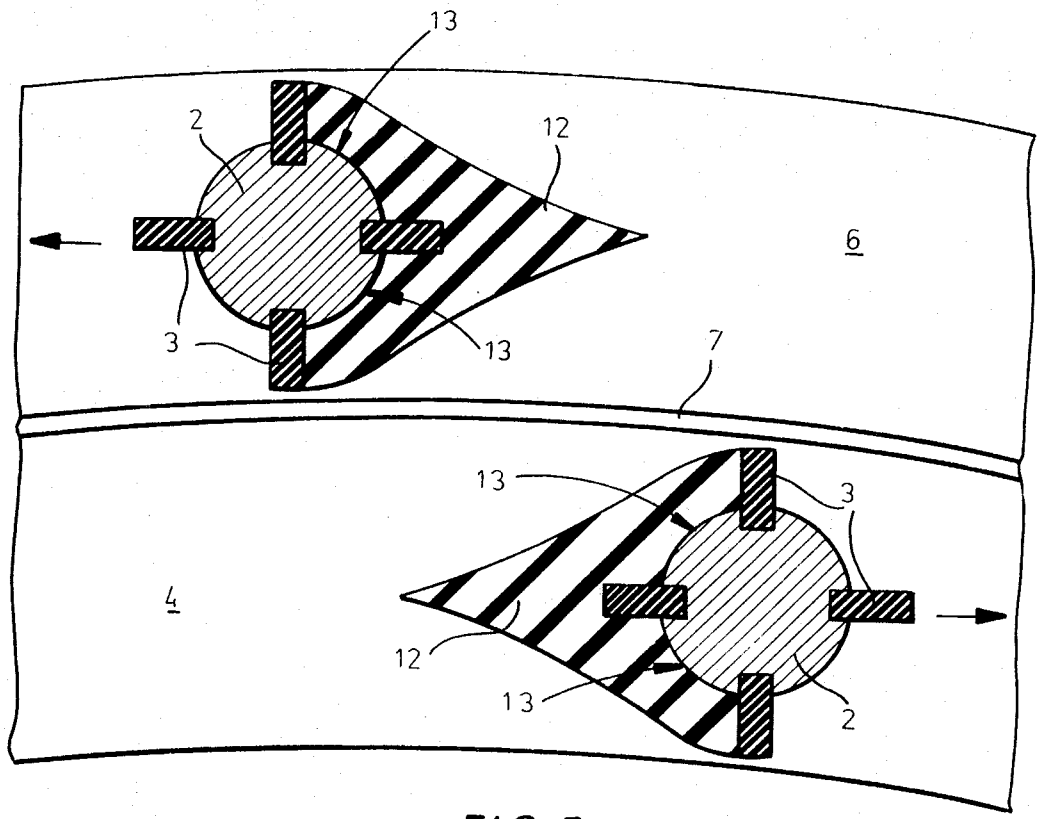
FIG. 3 is a detail view of the region III of FIG. 2.
Figure 3A:
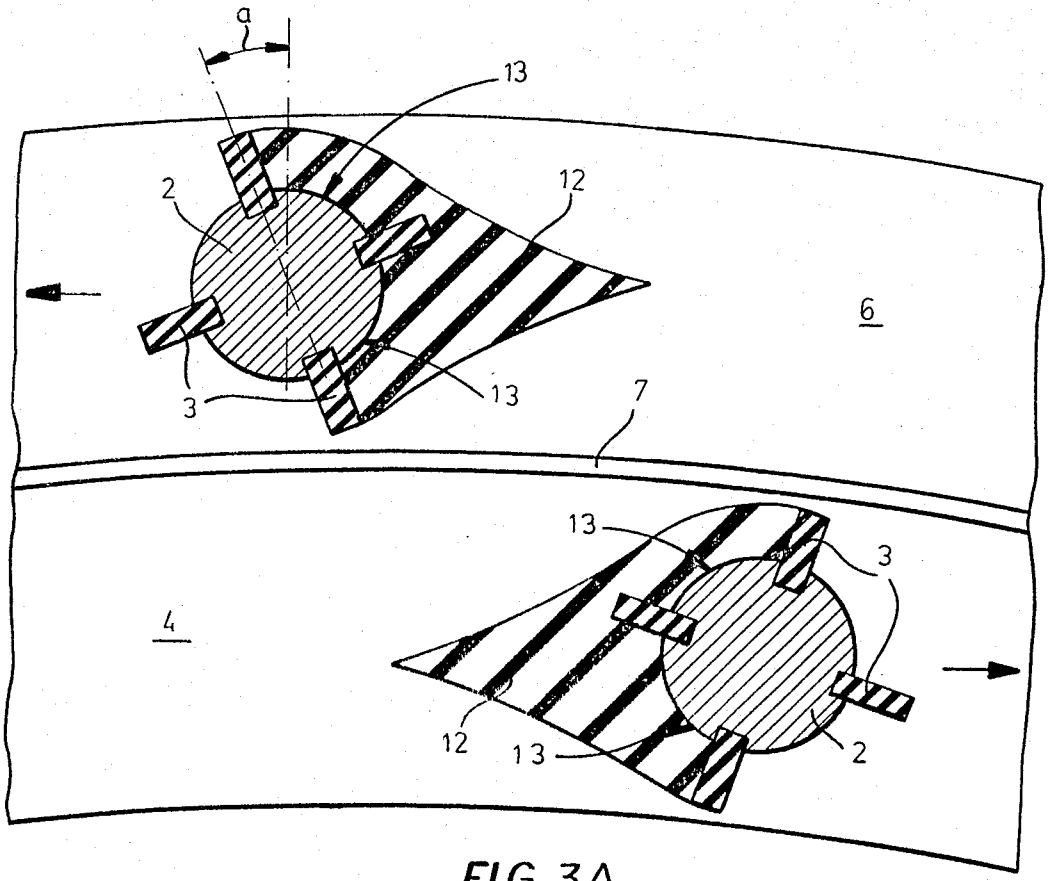
FIG. 3A is a view similar to FIG. 3 but showing a modification thereof.

As is especially evident from FIGS. 3 and 3A, the vanes 3 are radial with respect to the axis of the pins 2. The pins 2 can be angularly adjusted about their respective axis to achieve any desired orientation of the vanes as long as, in accordance with this invention, the vanes remain substantially radial or tangential with respect to the rotation circle of the respective set of vanes.

We prefer a cruciform orientation of the vanes so that at least some vanes of each pin are substantially radial and at least one vane is substantially tangential.

As can be seen from FIG. 1, moreover, the annular projections or rings 6 which in part delimit the milling chamber with the adjustment stabilizing rings, define with annular gaps or compartments 8 which are preferably maintained at a superatmospheric pressure by the supply of compressed air or another gas under pressure via the passages 9 in the shafts 5. To this end bores 10 may be provided within the rings 6 to communicate the compressed air to successively more outlying compartments 8. The juxtaposed surfaces of the rings 4 and 6, as can be seen from FIG. 4, have interfitting formations defining a labyrinth seal 11 with one another.

As will be apparent from FIG. 3 and especially from a comparison of FIG. 3 with FIG. 3A, the pocket-forming vanes 3 can be radial or tangential with respect to the rotation circle or can include angles of up to 20° from the radius. In this case, the radially outermost vane of each pin is inclined in the leading direction of an angle a of, say 15° while the radially innermost vane is inclined in a trailing direction by about 15°.

The pockets 13 downstream of the pins are filled with a trailing profile or body 12 of streamlined configuration, the streamlined bodies and the vanes being composed preferably of rubber.

Figure 6:
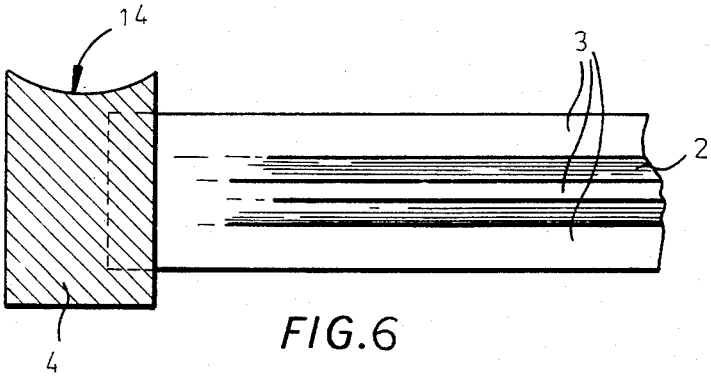
FIG. 6 is a detail section showing the concavity on a stabilizing ring for forming the aforementioned protective cushion.

As will be apparent from FIG. 6, moreover, the surface 14 of the rings 4 and 6 exposed to a stream of the material can be convex in a radial section to form a cushion. In the case where the rings 4 are provided with such concavities to define protective pockets, the rings 6 can be eliminated.

We claim:

1. In an impact mill having a housing containing a milling unit centrally supplied with a material to be milled and peripherally discharging comminuted material, the improvement wherein said milling unit comprises:

a pair of counterrotating discs rotatable about a common axis, each formed with a multiplicity of angularly spaced milling tools in respective rotation circles centered on said axis reaching toward an opposite disc whereby the tools of said discs interdigitate; and at least two diametrically opposed pocket-forming vanes on each of said tools extending substantially radially therefrom, one of said vanes of each tool being more remote from said axis than the other vane of the respective tool, the said one of said vanes being inclined forwardly in a direction of rotation of the respective disc at an angle greater than 0° and up to 20° to a radius from said axis and the said other vane of each tool being inclined rearwardly with respect to the direction of rotation of the respective disc at an angle greater than 0° and up to 20° to a radius from said axis.

2. The improvement defined in claim 1 wherein each of said tools comprises a respective pin and each pin is provided with two set at diametrically opposite vanes.

3. The improvement defined in claim 2 wherein the pins of each of said tool circle of the respective disc are bridged by a respective stabilizing ring.

4. The improvement defined in claim 1, further comprising a trailing profile of a streamlined cross section fixed to each pin at the downstream side thereof.

5. The improvement defined in claim 7 wherein said profile is composed of rubber.

6. The improvement defined in claim 1 wherein said vanes are composed of rubber.

7. The improvement defined in claim 1 wherein said pins are rotatable to adjust the angular orientation of said vanes.

8. The improvement defined in claim 1 wherein said rings have sides turned toward a flow of milled material, said sides being concave in a radial section to form cushions limiting erosion of said rings.

9. The improvement defined in claim 1 wherein the rings of each disc are disposed between annular projections of the other disc so that alternating annular projections and rings are formed on each side of a milling chamber, each of said sides being substantially smooth.

10. The improvement defined in claim 9 wherein said sides diverge outwardly.

11. The improvement defined in claim 9 wherein each ring defines with a pair of said annular projections flanking same, a respective annular compartment, further comprising means for pressurizing said annular compartments with a gas.

12. The improvement defined in claim 11 wherein each ring and a respective annular projection defining same are provided with interfitting means defining a labyrinth seal.

* * * * *